United States Patent [19]

Takezawa et al.

[11] Patent Number: 4,457,635

[45] Date of Patent: Jul. 3, 1984

[54] PRINTER ARM

[75] Inventors: Kenichiro Takezawa, Seto; Mineo Harada, Yutaka Kako, both of Owarjasahi, all of Japan

[73] Assignee: Hitachi, Ltd., Tokyo, Japan

[21] Appl. No.: 345,677

[22] Filed: Feb. 4, 1982

[30] Foreign Application Priority Data

Jun. 10, 1981 [JP] Japan ..... 56-89016

[51] Int. Cl.[3] ..... B41J 3/12

[52] U.S. Cl. ..... 400/124; 101/93.05

[58] Field of Search ..... 400/124, 691, 694, 452; 101/93, 48; 46/30

[56] References Cited

U.S. PATENT DOCUMENTS

| | | | |
|---|---|---|---|
| 490,235 | 1/1893 | Unz | 400/452 X |
| 1,092,230 | 4/1914 | Stickney | 400/452 X |
| 3,461,601 | 8/1969 | Kristiansen | 46/16 |
| 4,136,978 | 1/1979 | Bellinger et al. | 400/124 |

*Primary Examiner*—Paul T. Sewell

*Attorney, Agent, or Firm*—Antonelli, Terry & Wands

[57] ABSTRACT

A printer arm for transmitting an impact to a wire stylus in a wire matrix printing head is disclosed. The print arm includes a lever to one end of which the wire stylus is connected. The lever operates in the longitudinal direction of the wire stylus. The lever is a hollow member of a polygonal cross-section and has walls extending substantially in parallel to the direction of operation of the lever. Each of the side wall is provided with at least one through hole for reducing the weight of the lever. The portion of each side wall around each hole is protruded from the other portion of the side wall. This construction effectively suppresses the lateral vibration of the side walls of the lever and to improve the mechanical strength of the lever while reducing the weight of the same.

10 Claims, 8 Drawing Figures

PRINTER ARM

CROSS REFERENCE TO RELATED APPLICATION

The present invention is related to copending U.S. patent application Ser. No. 282,168 filed July 10, 1981 in name of Yutaka Kako for Electromagnetic Apparatus.

BACKGROUND OF THE INVENTION

The present invention relates to high speed dot matrix impact printers and, more particularly, to the structure of a printer arm actuated by an electromagnet for selectively operating wire stylus of a wire matrix print head.

Well-known wire matrix print heads generally have a plurality of wire styli arranged in matrix, and armatures and electromagnets are arranged correspondingly to these wire styli. In accordance with the dot pattern of a character to be printed, the electromagnets are selectively actuated so that desired wire styli are actuated through the armatures to thereby exert an impact on the printing paper through an ink ribbon to print on the printing paper a character, a symbol or a pattern comprising a dot assembly.

In this type of wire matrix head, there is a great demand for higher printing speed and, to the end, various efforts are being made to increase the speed of operation of the electromagnet or the armature. It is well known that the fundamental and effective measure to increase the printing speed is to reduce the moment of inertia of the armature in rotation around its supporting point without reducing the electromagnetic attracting force.

In another well-known method for reducing the moment of inertia of an armature as disclosed in U.S. Pat. No. 4,136,978, the armature is divided into a magnetic member and an actuator, and the actuator is made of a thin sheet material in a hollow configuration.

In order to further reduce the weight of the actuator or armature, it has been proposed to form one or more holes in the side walls of the armature lever. The thinning of the actuator or armature lever, as well as the formation of holes, for reducing the weight inconveniently causes a reduction of rigidity of the armature lever, often resulting in a lateral vibration of the side wall of the armature lever.

SUMMARY OF THE INVENTION

Accordingly, an object of the invention is to provide a print arm having a sufficiently reduced weight while maintaining a high rigidity.

Another object of the invention is to provide an armature structure having an armature lever, wherein the armature lever is a hollow member having a polygonal cross-section and is provided with holes formed in the side walls thereof and also with convexity and concavity formed on the side walls thereof, the convexity and concavities serving to reinforce the armature lever to thereby prevent the lateral vibration of the side walls of the armature lever.

To this end, according to the invention, there is provided an armature structure having a magnetic body portion and a lever coupled to the magnetic body portion, the lever serving as an operation element. The magnetic body portion is rotatably supported at its one end by a supporting means and is adapted to be operated by an electromagnetic means as the latter is energized. When this armature structure is used, particularly as the print arm of a wire matrix print head, a wire stylus is fixed to the end of the lever, so that, as the electromagnetic means activates the magnetic body portion, the lever is rotated to drive the wire stylus in the longitudinal direction of the stylus.

The armature lever in the armature structure of the invention is a hollow member constituted by thin walls to have a polygonal cross-section with side walls extending substantially in parallel with the direction of operation of the lever. These side walls are provided with convexities which serve to increase the rigidity of the lever.

According to another arrangement in accordance with the invention, each side wall is provided with at least one hole for reducing the weight and, at the same time, the portions of each side wall around the hole is projected from the major portion of the side wall.

According to still another arrangement, this portion of the side wall, i.e. the portion around each hole, is made to have a greater thickness than other portions.

These arrangements effectively improve the rigidity of the armature lever and suppresses the vibration of the portion of each side wall around the hole.

Figure 1:
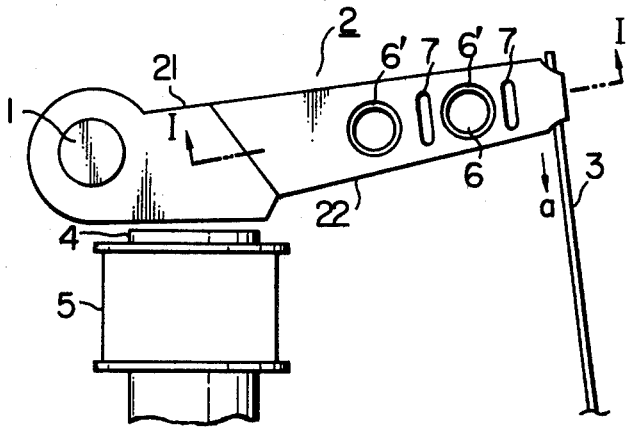
FIG. 1 is a side elevational view of a printer arm in accordance with an embodiment of the invention shown together with a mechanism for actuating the printer arm.

DESCRIPTION OF THE PREFERRED EMBODIMENTS:

Referring now to the drawings wherein like reference numerals are used throughout the various views to designate like parts and, more particularly to FIG. 1, according to this figure, a printer arm for use in a wire matrix print head, includes an armature generally designated by the reference numeral 2, serving as the printer arm and having a magnetic body portion generally designated by the reference numeral 21, and a lever generally designated by the reference numeral 22 connected to the magnetic body portion 21 and serving as an operation element. A wire stylus 3 is connected to the free end of the lever 22. As will be seen from FIG. 3, the magnetic body portion 21 is rotatably supported by a pin 1. An electromagnet for actuating the magnetic body portion 21 includes a core 4 and a coil 5 wound round the core 4. The arrangement is such that the magnetic body portion 21 is magnetically attracted by the core 4 as the coil 5 is selectively energized, so that the armature 2 is rotated in the direction of an arrow a around the pin 1. When the coil 5 is deenergized, the armature 2 is reset to the starting position by the force of a leaf spring which is not shown.

Figure 3:
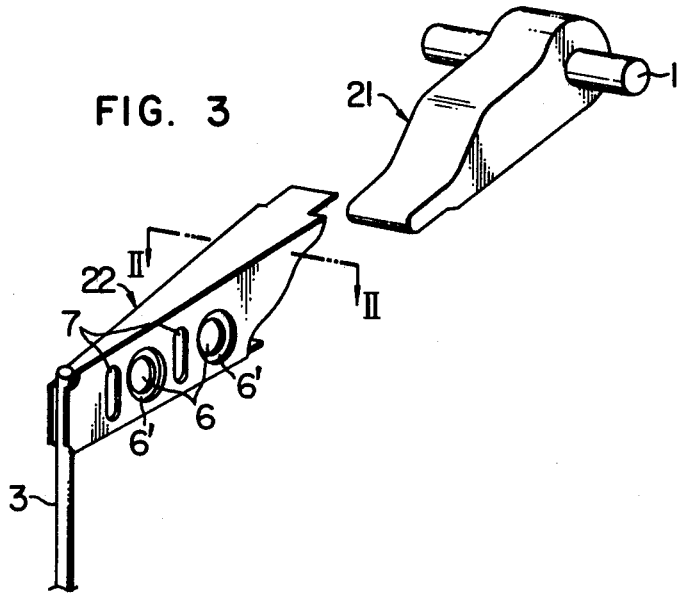
FIG. 3 is a perspective view of the separated printer arm shown in FIG. 1.

According to the invention, the lever 22, brazed or welded to the magnetic body portion 21, has a characteristic feature as explained hereinunder. Referring to FIG. 3 showing the lever 22 in the completed state, the lever 22 is a hollow member having a rectangular cross-section taken along the line II—II. The wire stylus 3 mentioned above is fixed, by brazing or welding, to the free end of the lever 22. In order to reduce the weight, the lever 22 is made of a material having a comparatively small specific weight, such as titanium, stainless steel or the like.

Figure 4:
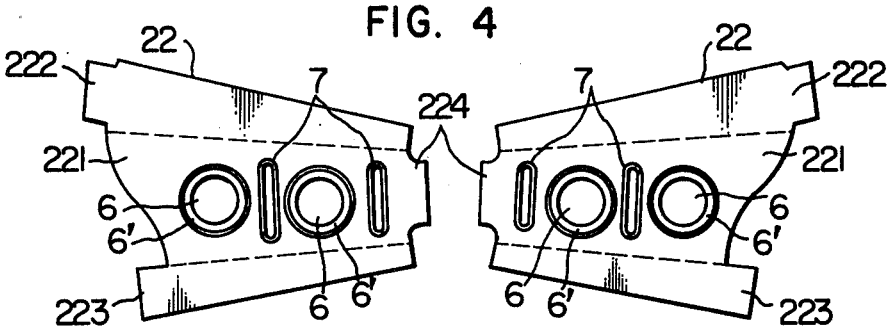
FIG. 4 is a developed view of the armature lever shown in FIG. 1 or 3.

Referring now to FIG. 4, the half-finished blank of the lever 22 is cut from a sheet of the material such as stainless steel by, for example, press work, into the form as illustrated in FIG. 4. The half-finished blank is prepared in a pair, and each of the half-finished blanks are folded or bent at a right angle in the same direction along the broken lines. More particularly, the blank bound to constitute the left part of the lever is bent substantially in a open bracket-like form, while the other blank bound to constitute the right part of the lever is bent substantially in a a complimentary closed bracket-like form. The upper flaps 222 of both blanks thus bent are superposed and connected to each other by brazing or welding. Similarly, the lower flaps 223 are superposed and connected to each other by brazing or welding. The wire stylus 3 is fixed to the inner surfaces of the opposing ends 224 of the two blanks. The hollow lever 22 is thus constructed. The characteristic feature of the lever 22 resides also in the construction of the side walls 221 of the lever.

As will be seen from FIGS. 1, 2, 3 and 4, each of the side walls 221 is provided with a plurality of through holes 6 and convexities 7. As will be best seen from FIG. 2, the portion 6' around each hole 6 and the convexities 7 are formed to project inwardly from the major part of each side wall 221. These holes 6 and convexities 7 are formed by press work during the formation of the half-finished blank explained before in connection with FIG. 4.

The through holes 6 serve to reduce the weight of the lever 22, while the convexities 7 serve to increase the rigidity of the same.

Preferably, the holes 6 and the convexities 7 are arranged to appear alternatingly along the length of the lever 22, and the convexities 7 are preferably formed such that their longitudinal axes extend at a right angle to the longitudinal axis of the lever 22, i.e. in the direction of operation of the lever 22, as will be seen from FIGS. 1 through 4, for the reasons explained hereinunder.

When the armature 2 is driven in the direction of the arrow a to make the end of the wire stylus 3 impact the printing medium, the reactional force is generated to act on the lever 22. This reactional force causes a lateral vibration of the side walls 221 which extend substantially in parallel with the direction of operation of the lever 22. Consequently, larger distortion of the material is generated in the portion of the side wall around each hole 6 to produce an unacceptably large stress in excess of the allowable stress, often resulting in a breakdown of the lever 22. According to the invention, this problem is fairly overcome because the undesirable concentration of vibration to the peripheral portion of each hole 6 is avoided to suppress the propagation of stress to the cut end of each hole 6. In addition, the convexity 7 extending in the direction of operation of the lever 22 further suppresses the lateral vibration of the side walls of the lever 22. The convexity 7 is effective also in suppressing the propagation of the stress to the periphery of each hole 6. Consequently, the distortion or deflection of the lever 22 is effectively prevented and the dynamic strength of the lever 22 is increased by the multiplied effect of the combination of the convexities 7 and the holes 6. This in turn permits a further reduction of wall thickness of the lever 22 and, hence, the reduction of weight of the same.

Figure 2:
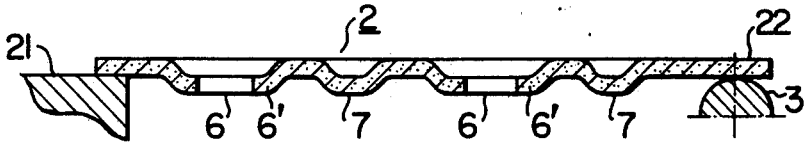
FIG. 2 is a cross-sectional view taken along the line I—I of FIG. 1.
Figure 5:
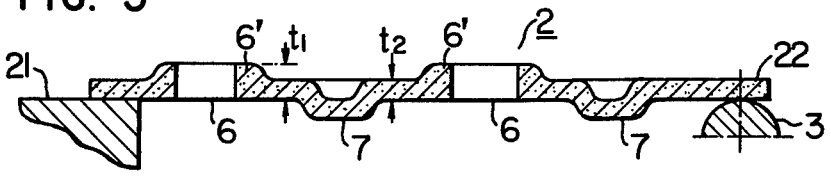
FIGS. 5 and 6 are cross-sectional views of another embodiment of the invention, showing particularly modifications of the section taken along the line I—I of FIG. 1.

While the periphery 6' of hole 6 and the convexity 7 protrude in the same direction and the side wall 221 has a uniform thickness in the lever 22 shown in FIG. 2, the periphery 6' of the hole 6 and the convexity 7 protrude in opposite directions from each other, and the side wall is made to have a greater thickness $t_1$ at the periphery 6' of each hole 6 than that $t_2$ at other portions, in the lever 22 shown in FIG. 5. Consequently, the concentration of the stress to the periphery 6' of each hole 6 is effectively suppressed to further ensure the strength of the periphery 6'.

Figure 6:
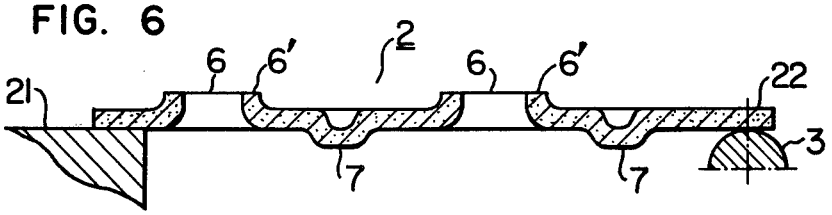

In still another embodiment shown in FIG. 6, the periphery 6' of each hole 6 is further protruded, although the side wall 221 of the lever 22 has a uniform thickness.

Figure 7:
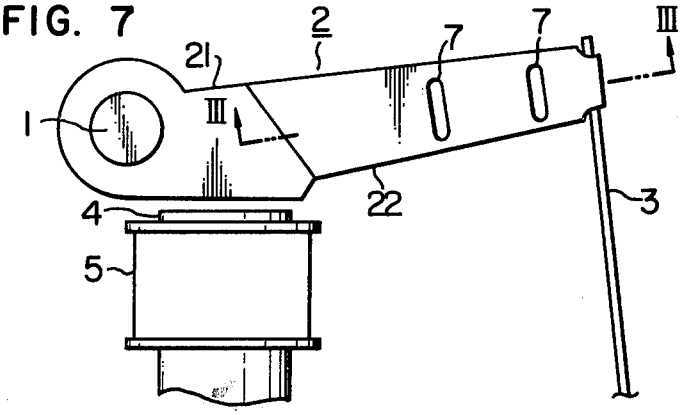
FIG. 7 is a side elevational view of a printer arm and an actuating mechanism therefor in accordance with still another embodiment of the invention.
Figure 8:
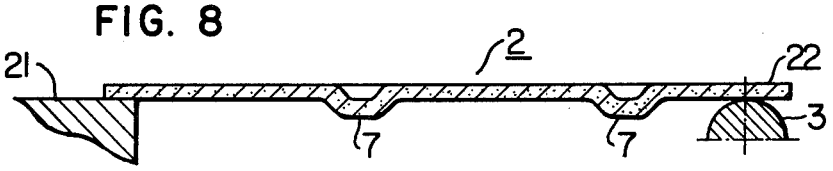
FIG. 8 is a cross-sectional view taken along the line III—III of FIG. 7.

FIGS. 7 and 8 show a further embodiment of the invention which is distinguished from the embodiment shown in FIGS. 1 and 2 by the fact that the side wall 221 of the lever 22 has no hole 6 nor projection of the periphery 6'. In this case, however, the strength or rigidity of the side wall 221 is increased by the presence of the convexities 7, although the weight of the lever 22 is increased due to the elimination of the through holes 6.

Although the invention has been described through specific embodiments, these embodiments are not exclusive and various changes and modifications may be imparted thereto. For information, the side wall of the lever can have other shapes and numbers of through holes 6 and convexities 7 than described. Also, the directions of protrusions of the periphery 6' of each hole 6 and the direction of protrusion of each convexity 7 may be altered. The pattern of arrangement of the holes 6 and the convexities 7 also can be varied as desired.

What is claimed is:

1. A printer arm for transmitting an impact to a wire stylus in a wire matrix print head comprising:

a wire stylus having a predetermined length; and a lever to one end of which said wire stylus is fixed at a portion thereof, said lever being a hollow member of a polygonal cross-section and having side walls substantially parallel to a longitudinal axis of said wire stylus, each of said side walls of said lever is provided with at least one through hole, a portion of said side wall around said hole is provided with a convexity, said lever is made from a thin sheet material, and the portion around said hole has a thickness greater than a thickness of other portions of said side wall.

2. A printer arm according to claim 1, characterized by further comprising:

at least one second convexity formed in a portion of said side wall of said lever other than said portion around said hole.

3. A printer arm according to claim 2, wherein a second convexity protrudes in a direction opposite to a direction of protrusion of the first convexity around each hole.

4. A printer arm for transmitting an impact to a wire stylus in a wire matrix print head comprising:

a wire stylus having a predetermined length; and a lever having a first end to which said wire stylus is fixed at a portion thereof, said lever being a hollow member of a polyogonal cross-section and having side walls substantially parallel to a longitudinal axis of said wire stylus, each of said side walls of said lever is provided with at least one through hole, and said side walls of said lever are provided with a plurality of convexities each of which have a longitudinal axis extending substantially in parallel with a direction of the longitudinal axis of said wire stylus.

5. A printer arm for transmitting an impact to a wire stylus in a wire matrix print head comprising:

a wire stylus having a predetermined length; and a lever having a first end to which said wire stylus is fixed at a portion thereof, said lever being a hollow member of a polyogonal cross-section and having side walls substantially parallel to a longitudinal axis of said wire stylus, each of said side walls of said lever are provided with a plurality of convexities, and each convexity has a longitudinal axis extending substantially in parallel with a direction of the longitudinal axis of the wire stylus.

6. A printer arm according to claim 5, wherein at least one through hole is provided in each of said side walls, and wherein a wall portion around each of said holes has a thickness greater than a thickness of other portions of said side walls.

7. An armature structure adapted to be rotatingly driven by an electromagnet comprising:

a magnetic body portion adapted to be rotatingly driven around a predetermined axis by a magnetic force exerted by said electromagnet; and a hollow lever of a polygonal cross-section connected to said magnetic body portion, said lever having walls extending substantially in parallel to the direction of drive of said magnetic body portion, each of said side walls of said lever is provided with at least one through hole, a portion of said side wall around said hole is provided with a convexity, said hollow lever is made from a thin sheet material, and a portion around each of said through holes has a thickness greater than a thickness of other portions of each of said side walls.

8. A printer arm for transmitting an impact to a wire stylus in a wire matrix print head comprising:

a wire stylus having a predetermined length; and a lever to one end of which said wire stylus is fixed at a portion thereof, said lever being a hollow member of a polygonal cross-section and having side walls substantially parallel to a longitudinal axis of said wire stylus, a plurality of through holes are provided in each of said side walls, said through holes being spaced from each other in an axial direction of said lever, a plurality of convexities are provided and arranged in an alternating fashion with said through holes, said lever is made from a thin sheet material and the wall portions around each of said through holes has a thickness greater than a thickness of other portions of the side walls.

9. A printer arm according to claim 8, wherein each of the convexities has a longitudinal axis extending substantially in parallel with a direction of a longitudinal axis of said wire stylis.

10. A printer arm for transmitting an impact to a wire stylus in a wire matrix print head comprising:

a wire stylus having a predetermined length; and a lever to one end of which said wire stylus is fixed at a portion thereof, said lever being a hollow member of a polygonal cross-section and having side walls substantially parallel to a longitudinal axis of said wire stylus, a plurality of through holes are provided in each of said side walls, said through holes being spaced from each other in an axial direction of said lever, a plurality of convexities are provided and arranged in an alternating fashion with said through holes, each of the convexities has a longitudinal axis extending substantially in parallel with a direction of a longitudinal axis of said wire stylus.

* * * * *